United States Patent [19]

Heise et al.

[11] Patent Number: 4,458,447

[45] Date of Patent: Jul. 10, 1984

[54] REVOLVING DOOR SYSTEM

[75] Inventors: Stanley R. Heise, Blaine; Michael D. Blackston, Brooklyn Park, both of Minn.; Michael B. Zekich, Pasadena, Calif.

[73] Assignee: Heise Manufacturing Co., Inc., Fridley, Minn.

[21] Appl. No.: 374,899

[22] Filed: May 4, 1982

[51] Int. Cl.[3] ..... E05D 15/02

[52] U.S. Cl. ..... 49/44; 49/2

[58] Field of Search ..... 49/42, 44, 2

[56] References Cited

U.S. PATENT DOCUMENTS

| | | | |
|---|---|---|---|
| 2,341,545 | 2/1944 | Hagenbook . | |
| 2,348,900 | 5/1944 | Hagenbook | 49/42 X |
| 2,523,980 | 9/1950 | Whiteford | 49/44 |
| 2,537,418 | 1/1951 | Nordin | 49/44 X |
| 2,954,971 | 10/1960 | Simpson . | |
| 3,020,038 | 2/1962 | Simpson . | |
| 3,045,615 | 7/1962 | Atchison | 49/42 X |
| 3,285,209 | 11/1966 | Pace . | |
| 3,307,660 | 3/1967 | Sheckells . | |
| 3,308,912 | 3/1967 | Sheckells . | |
| 3,349,876 | 10/1967 | Sheckells . | |
| 3,403,571 | 10/1968 | Sheckells . | |
| 3,473,261 | 10/1969 | Sheckells . | |
| 3,497,997 | 3/1970 | Sheckells . | |
| 3,526,820 | 9/1970 | Sheckells . | |
| 3,717,954 | 2/1973 | Sheckells . | |
| 3,762,098 | 10/1973 | Sheckells . | |
| 3,766,686 | 10/1973 | Sheckells . | |
| 3,793,773 | 2/1974 | Sheckells . | |
| 3,886,684 | 6/1975 | Sheckells . | |
| 3,968,595 | 7/1976 | Sheckells . | |
| 4,054,008 | 10/1977 | Phillips | 49/2 X |
| 4,063,519 | 12/1977 | Pretini . | |
| 4,154,023 | 5/1979 | Carroll . | |
| 4,295,297 | 10/1981 | Carroll et al. . | |

FOREIGN PATENT DOCUMENTS

| | | | |
|---|---|---|---|
| 551522 | 6/1932 | Fed. Rep. of Germany | 49/30 |

OTHER PUBLICATIONS

Security Engineering, Inc., Catalog Sheet, Series 16.9a/Sc, no date.

"Commutator Powered Rotating Signs", no literature or date available but well prior to the filing of this application.

*Primary Examiner*—Kenneth Downey

*Attorney, Agent, or Firm*—Merchant, Gould, Smith, Edell, Welter & Schmidt

[57] ABSTRACT

A revolving door system has a central axis defining center shaft and three wing hangers rigidly joined and extending in equidistant spaced apart relationship about the center shaft's upper portion. Pivots couple three planar upright wings in closely spaced apart relationship to the center shaft. A magnetic latch on each wing hanger is spaced apart from the central axis more remote than the pivot, releasably maintaining the wings in ganged alignment with the hangers.

A pair of facing substantially semicircular walls, spaced apart to define regions of ingress and egress, partially surrounds the wings and shaft on opposite sides. Each wall has two adjacent movable side panels hinged on opposite sides of a center panel, movable from a nominally enclosing position to an open panic position.

Disposed remote from the adjacent side panel, a magnetic latch releasably maintains the side panels in circular alignment with the enclosure. A smoke detector is coupled to the electromagnetic latch means to cause a disengagement of the latch means in response to an indication.

In a panic situation, release of the latch allows the wings to be released from the hangers and pivoted freely while the side panels are allowed to pivot about the hinges to enhance the egress frontage to thereby potentially increase the flow of people exiting from the building structure.

17 Claims, 13 Drawing Figures

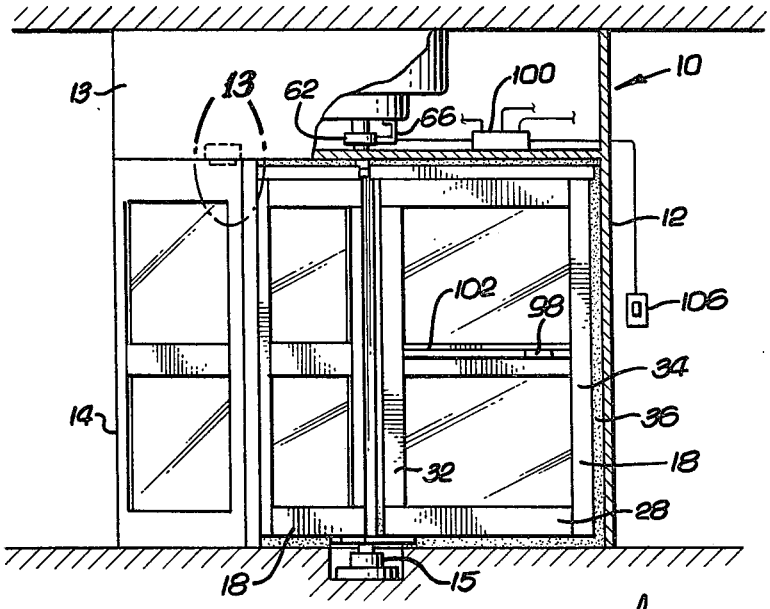
Fig. 5
Fig. 6
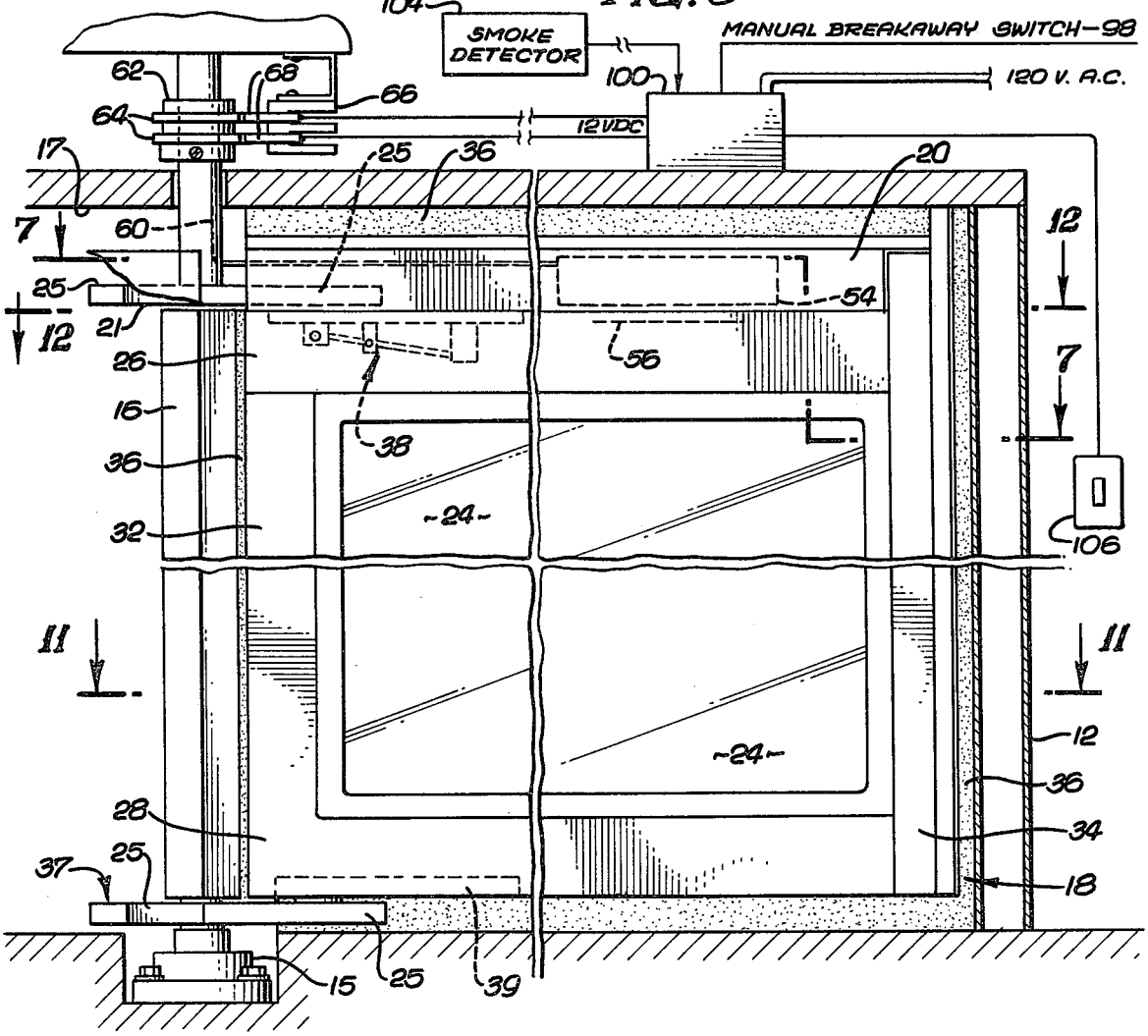

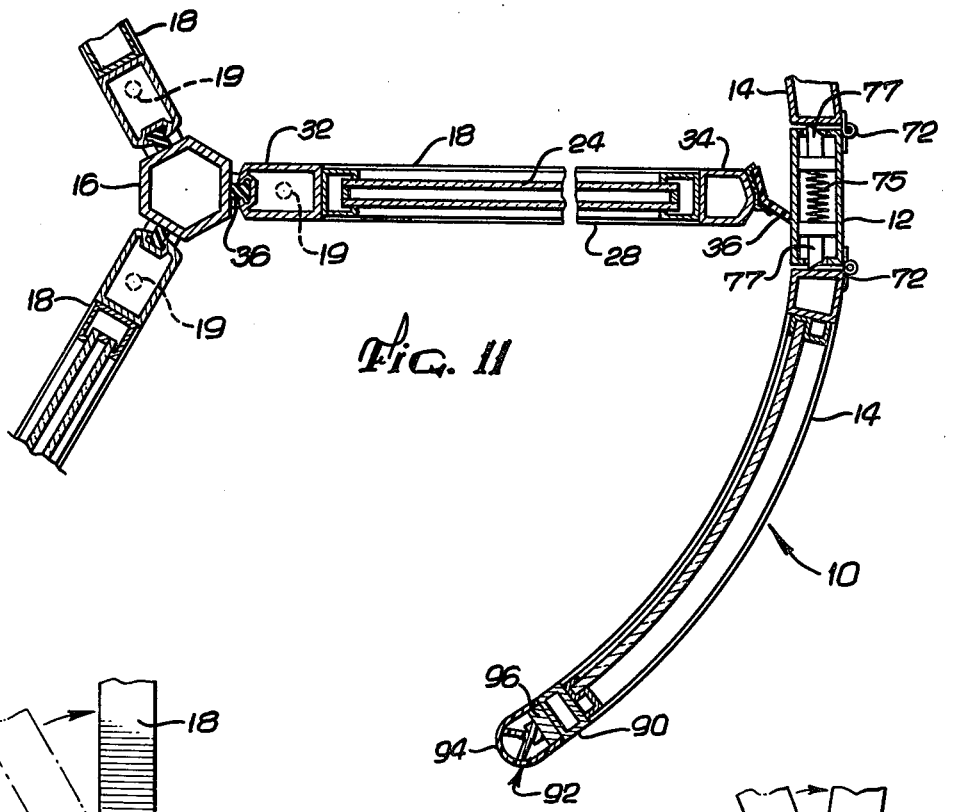
FIG. 11
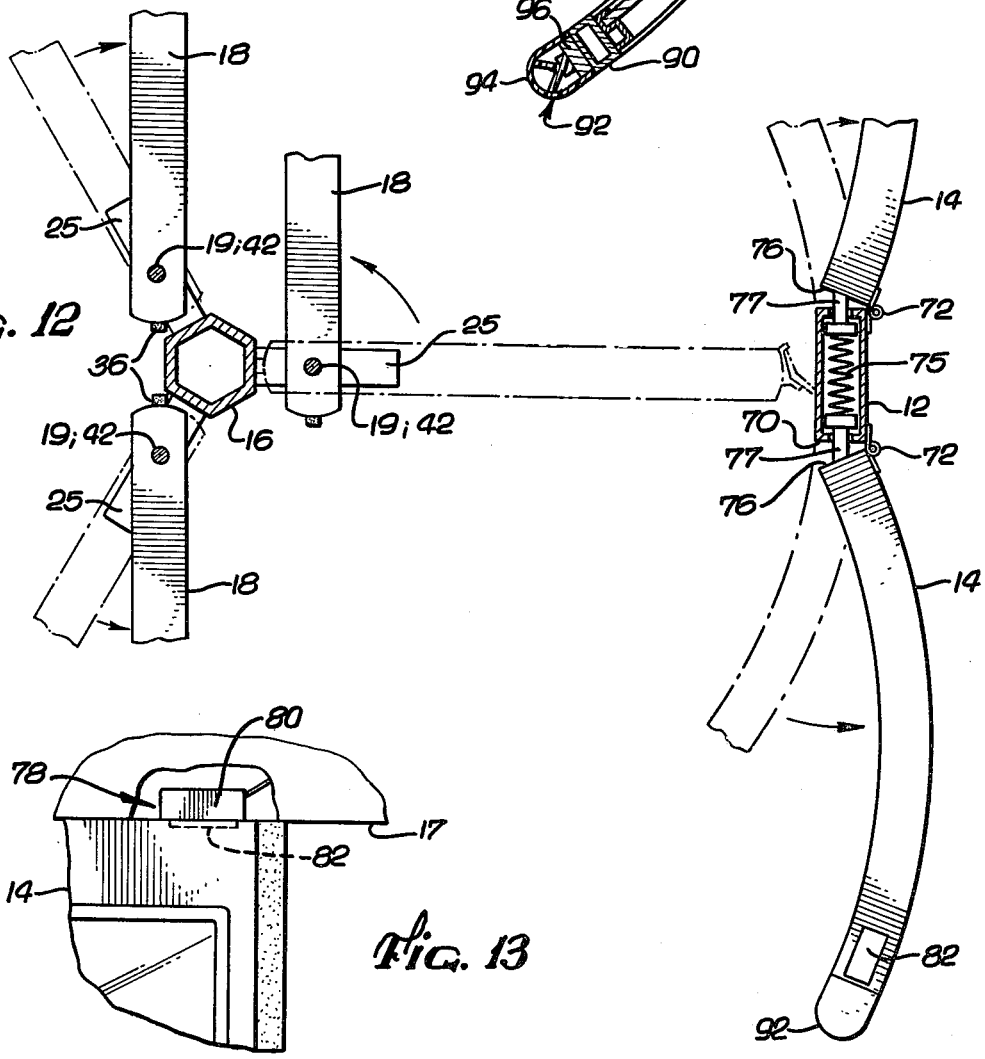
FIG. 12
FIG. 13

REVOLVING DOOR SYSTEM

BACKGROUND OF THE INVENTION

1. Field of the Invention

This invention relates to revolving doors. More particularly the invention relates to releasing systems for collapsing and folding door wings in cases of panic.

2. Description of the Prior Art

Revolving doors have long been useful in providing ingress and egress to buildings while minimizing the temperature differential losses from the building's interior to exterior ambient air. One concern with the use of revolving doors is that in case of fires or other emergencies, the capacity to let people out of the building is limited. Much of the frontage traversed by the door cannot be used to permit escape from the building. This is recognized in building codes requiring exit door frontage in addition to that provided by any revolving doors.

To increase the ability to allow people to escape in a panic situation, revolving doors having collapsible wings have been used. Typically, such doors have been designed for an individual to purposefully actuate an emergency breakaway option integrated into the revolving door.

A problem which has existed with collaspable revolving doors is that of stack pressure. That is the difference in air pressure created between the exterior of the building and the air within the building. There is generally a temperature difference between that of the air inside and outside. This is as result of the external ambient environment and the space conditioning system within the building, either making the interior at a warmer or cooler temperature than the outside ambient conditions. The greater density of the colder air with respect to that of the warmer air causes the pressure differential. When the door rotates, only a small portion of the air in the building escapes. In fact, this indeed is one of the advantages of using revolving doors as it entrains the internal ambient environment to a great extent, thus economizing on energy costs by preventing escape of the internal ambient environment from the building.

But there is a sensitivity problem. The doors must be adjusted so that the collapsing feature may be actuated by even the frailest of individuals, yet it must not be actuated in non panic situations. The collapsing feature must not require active thinking of the person seeking egress from the building. The stack pressure referred to above creates a problem, because it can be sufficient to actuate the collapsing feature. But if the sensitivity to the pressure is reduced, then the weak individual will be unable to cause the collapsing feature to actuate in an emergency situation.

SUMMARY OF THE INVENTION

A revolving door in accordance with the invention generally includes a central rotator having upright planar door panels or wings spaced apart about the rotator. The wings are coupled pivotally to the rotator. Extending radially from and fixed to the rotator are circumferentially spaced apart hangers. The hangers are releasably coupled to each of the wings so that upon response to the energization, each wing is released from the hangers and become freely pivotable.

Spaced apart facing semicircular panels partially enclose the rotator and a canopy encloses the top of the door and the wings. In some examples, each semicircular wall comprises adjacent side panels pivotally coupled to a central panel. In addition, each side panel has a releaseable latch arrangement. In response to an indication, the latch arrangement is released from the side panels allowing pivotal outward movement of the side panels.

In a more specific example, the central rotator is a circular shaft and the hangers are bars which extend radially from the top of the shaft. The wings are coupled pivotably about an axis spaced apart from the shaft axis and a magnetic latch disposed on the hanger bars is disposed more remote from the shaft axis than the pivotal wing coupling. Hinges pivotally couple each side panel to opposing central panels of each semicircular wall. A latch arrangement is coupled to engage the upper portion of each adjacent side panel remote from the hinges which join the adjacent side panel to the opposing central panels.

Conductors supplying power to the latch arrangement are disposed along the hanger and the rotator. The conductors are coupled to a commutator revolving with the rotator. Fixed contactors supply current through the commutator for the latching arrangement. Walking beam pivot assemblies allow upper pivots of each wing to be pivotally coupled to cantilevered arms after lower pivots are in place.

BRIEF DESCRIPTION OF THE DRAWINGS

A better understanding of the invention may be had by reference to the following description taken in conjunction with the accompanying drawings in which:

FIG. 5 is a cross-sectional view with portions exposed and portions removed taken along lines 5—5 of FIG. 3;

FIG. 6 is a detailed cross-sectional view with portions broken away of the invention depicted in FIG. 1;

FIG. 11 is a cross-sectional plan view of the invention taken along lines 11—11 of FIG. 6;

FIG. 12 is a cross-sectional plan view of the invention taken along lines 12—12 of FIG. 6; and FIG. 13 is a detailed elevational view of a portion of the invention as depicted in FIG. 5.

DETAILED DESCRIPTION

Figure 1:
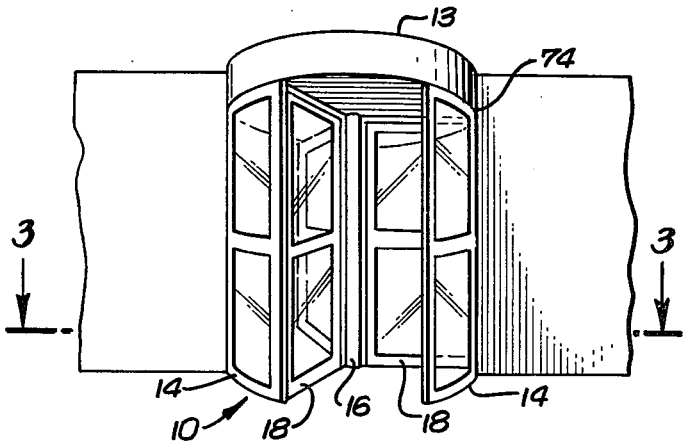
FIG. 1 is a perspective view of an example of a revolving door in accordance with this invention.

With particular reference to FIG. 1 through FIG. 13, a revolving door system in accordance with this invention generally comprises a drum 10 having a plurality of upright curved substantially semicircular walls 11, including opposing central panels 12, disposed in facing relationship and adjacent side panels 14 adjoining the opposing central panels 12. A canopy 13 covers the walls 11. The semicircular walls 11 are disposed on opposite sides of the drum 10. The space between the opposing circular panels 11 provides a limited region for ingress and egress from a building structure.

Disposed central to the drum 10 is a rotatable central upright shaft 16 defining a central axis, and extending from a floor bearing 15 and through a ceiling 17 of the drum 10. The shaft 16 may be cylindrical as in FIG. 3 or of other cross-section as shown in FIG. 11. Three upright planar door panels or wings 18 are radially positioned about the shaft 16, and thus about a central door axis and are disposed in an arcuate spaced apart relationship of 120°. As best viewed in FIG. 12, the wings 18 are pivotally coupled about pivots 19 adjacent the shaft 16 to provide for the collapsability of the wings 18 in an emergency situation.

Figure 3:
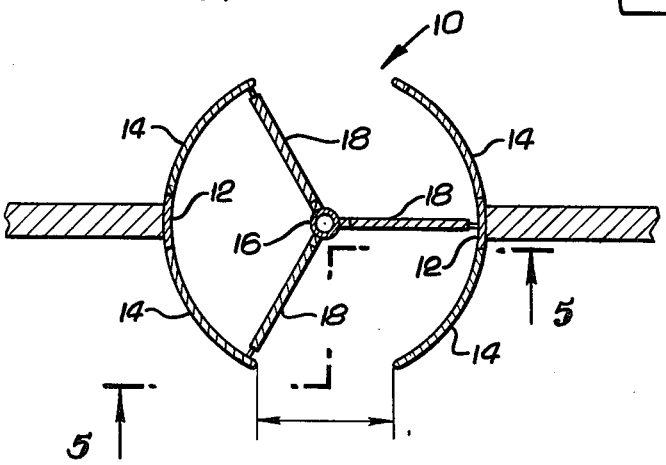
FIG. 3 is a cross-sectional plan view taken along lines 3—3 of FIG. 1.

To maintain the wings 18 in a normally fixed relationship to the shaft 16 as in FIG. 1, FIG. 3 and FIG. 11, three wing hangers 20 extend radially in spaced apart equidistant relationship cantilevered adjacent to the central shaft 16. As best viewed in FIG. 8, the wing hangers 20 comprise elongated aluminum tubes of square cross section. Thus, each wing hanger 20 extends outwardly and radially from the shaft 16 and is spaced apart 120° from the other two wing hangers 20. The hangers 20 are coupled to the shaft 16 by a three arm top spider 21. The top spider 21 is fastened to the shaft 16 by screws 23. Three arms 25 extending radially from the top spider 21 are each inserted in and fastened to the hanger 20 as viewed in FIG. 7 and FIG. 8.

The wings 18 comprise glass panels 24, and are supported by a frame comprising a top rail 26 parallel and adjacent to the wing hanger 20, a bottom rail 28 at the lower portion of the wing 18, and a mid-rail 30 spacing apart upper and lower glass panels 24. In addition, an inner upright stile or rail 32 bounds the glass panels 24 adjacent the shaft 16, and an outer upright stile or rail 34 is adjacent to the drum 10 as shown in FIG. 11. The inner upright rail 32 does not actually contact the shaft 16, as viewed in FIG. 12, but rather weatherstripping 36 disposed along the upright side 35 of the rail is disposed adjacent the shaft 16.

A bottom spider 37 comprises a planar laterally disposed element having three arms 25. The bottom spider 37 is coaxial with and rigidly affixed to the shaft 16 in spaced apart relationship to the upper spider 21. The bottom spider pivotally supports each of the doors about the pivot 19, defining a vertical axis spaced apart from the center shaft axis. The spacing between the pivot axis and the shaft axis is sufficient to allow clearance of adjacent inward portions of the wings 18. This allows the folding or collapsing of the doors, as depicted in FIG. 12, without interference of the portions of the wings 18 adjacent to and against the center shaft 16. Note that it is desirable to have sufficient clearance to allow rotation of the wings 18 about pivots 19 in excess of 90°.

Figure 9:
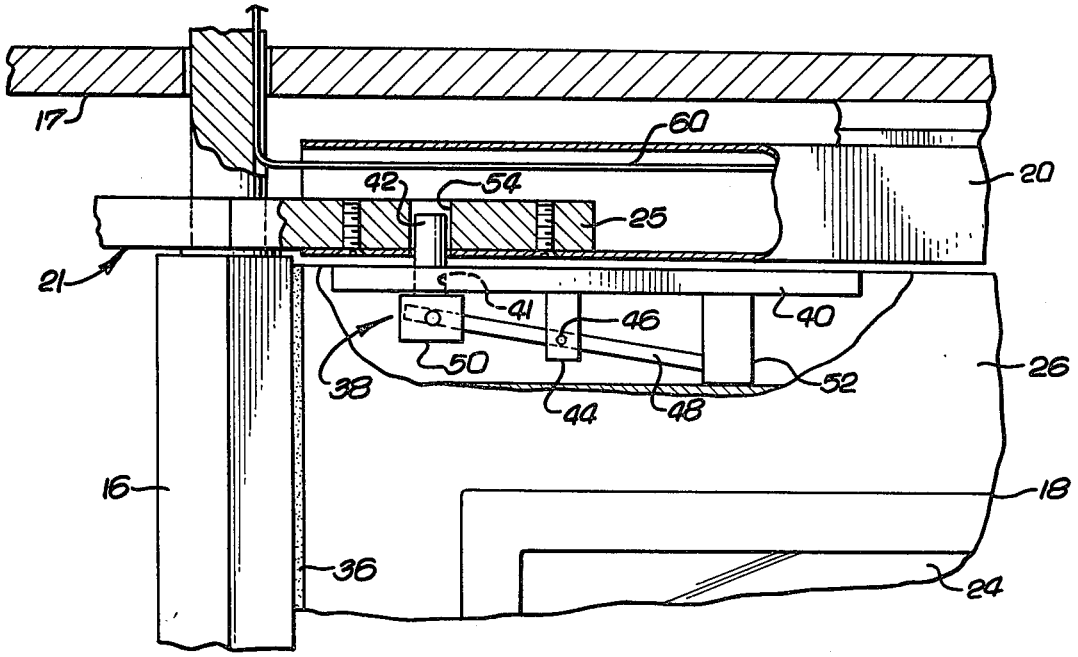
FIG. 9 is a detailed elevational view with portions exposed and portions removed of a portion of the invention depicted in FIG. 6.
Figure 10:
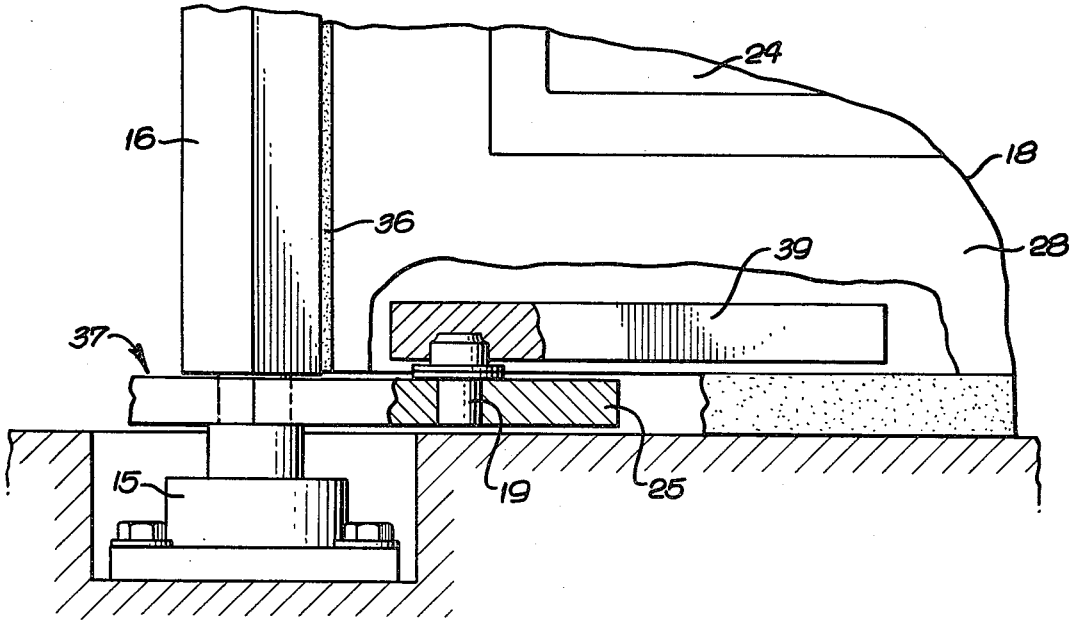
FIG. 10 is a detailed elevational view of a portion of the invention depicted in FIG. 6.

As viewed in FIG. 9 and FIG. 10, the wings 18 are pivotally coupled to the top and bottom spiders 21, 37. A pivot 19 extends upwardly from the bottom spider arms 25. An aperture block 39 defines a pivot aperture disposed within the bottom rail 28. The pivot 19 is rotatably disposed in the pivot aperture of the aperture block 39. The wings 18 are rotatable about the pivot 19 to define the vertical pivot axis. On the top rail 21, a walking beam pivot assembly 38 includes a laterally disposed plate 40 having a rod aperture 41 and a pivot 42 vertically diposed through the rod aperture 41. The plate is fixed to the top rail 26 of each wing 18, through, alternatively, the plate could be joined to each hanger 20. A fulcrum bar 44 is disposed in spaced apart relationship to the pivot 42 and extends normally from the plate 40 opposite the direction in which the pivot 42 extends from the plate 40. The fulcrum bar includes a fulcrum pivot 46. A lever arm 48 is pivotally coupled to a rod block 50 which is joined to the pivot 42. A threaded lever arm control bar 52 is coupled to the plate 40 spaced apart from both the pivot 42 and the fulcrum bar 44. The lever arm 48 has a slotted aperture coupled through a pin 49 to the control bar 52. Movement of the control bar 52 provides for controlled adjustment of the pivot 42 through the rod aperture 41. The walking beam pivot assembly 38 allows the coupling of the wings 18 to the top spider 21 allowing the pivot 42 to move into a pivot aperture 54 of the hanger 20 and the spider arms 25, after the wing 18 has already been placed on the pivots 19 of the bottom spider 21. Absent any further structure, the wings 18 could thus move and pivot freely such as to the position as shown in FIG. 12.

However, under normal conditions, the wings 18 should be spaced at 120° and rotate in a fixed position with the shaft 16. As viewed in FIG. 6, this is achieved by utilizing a latching arrangement disposed along the wing hanger 20 and spaced apart from the pivots 19, 42 more remote from the central axis of the center shaft 16. Preferably, the latching arrangement comprises an electromagnet 54 disposed within the wing hanger 20 and a mating armature 56 disposed within the top rail 26. An example of a suitable latching arrangement is a model 3900 electromagnetic lock supplied by Security Engineering, Inc. of Forestville, Conn. 06010. The shear holding force in this configuration can exceed 500 kg., typically consuming only about 0.2 amps at 12 volts D.C. In order to maintain the wings 18 in a latched condition with respect to the hangers 20, the electromagnet 54 must be energized. Power to the electromagnet 54 is supplied by wiring 60 which is disposed within the hangers 20 and then passes upward through the shaft 16. A commutating collar 62 coaxial with the shaft 16 and above the ceiling 17 is coupled to the wiring 60. The collar 62 has two circular contacting rings 64. A brush support 66 has a pair of spaced apart contactors or brushes 68 mating with the contacting rings 64. The brushes 68 are coupled to a power sources, such as 12 volts D.C. to power the electromagnet 48. The brushes are typically copper. The brush support 66 may be spring loaded to bias the brushes 68 against the contacting rings 64.

Figure 2:
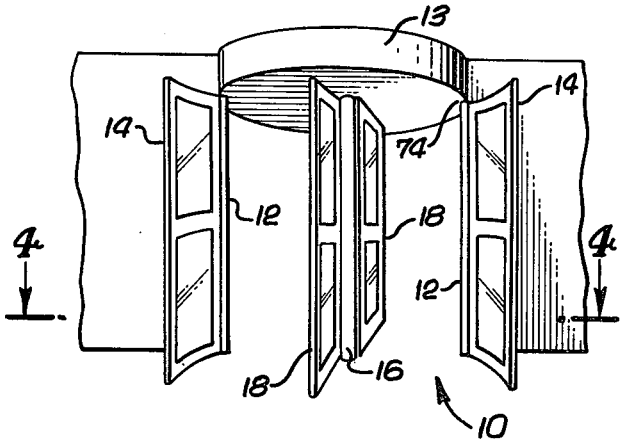
FIG. 2 is a perspective view of the invention depicted in FIG. 1.

With particular reference to FIGS. 2 and 12, the opposing central panels 12 have upright side edges 70. An upright longitudinal piano hinge 72 is joined at each upright side edge 70 of the central panels 12. The opposing central panels 12 are joined at the top to a facie 74 of the drum 10, adjacent the ceiling 17. The adjacent side panels 14 have an upright longitudinal edge 76 adjacent to and coupled to the opposing central panels 12 so that the adjacent side panels 14 can pivot outwardly about the upright longitudinal hinges 72. One or more springs 75 bear on plungers 77 extending from the curved panels 12 to bear on the side edges 70 of the panels 14 to bias the side panels toward an opening position. On the ceiling 17 of the drum 10 remote from each of the adjacent side panels 14, are disposed electromagnetic latch arrangements 78 similar to the latch arrangements 38 previously described. The electromagnetic latch arrangements 78 comprises an electromagnet 80 and an armature 82. For maximum holding leverage, the latch arrangements 78 are disposed remote from the hinges 72, as viewed in FIG. 12 and FIG. 13.

The adjacent side panels 14 have outermost vertical rails 90 which are upright and extend to expose the ingress and egress openings of the revolving door. The outermost rails are typically aluminum tubing. Extending from the outermost rails is a rubber bumper 92 along the length of the outermost rails 90. The rubber bumper 92 comprises a longitudinal U-shaped portion 94 and is in communication with a ribbon switch 96. The ribbon switch 96 is a safety device which may cause the actuation of a brake to prevent further rotation of the shaft 16 and the wings 18.

A manual breakaway switch 98, as depicted in FIG. 5 may be used in connection with the breakaway arrangements described. It is generally preferable to use some form of relay or sensor coupled to a controller arrangement 100 to cause deactuation of the electromagnets 48, 80 or other releasing arrangement. For example a smoke detector may be used to supply a signal or other indication to cause deenergization of the electromagnets 48, 80. However, in some embodiments, it may be desirable to require some nominal effort on the part of an individual to cause the opening of the side panels 14 and the folding of the wings 18. By way of example, the switch 98 may be coupled to mechanical panic hardware attached to the door leaf. This is a bar 102 on the actual door leaf, running across the width of the door. When pressed, the panic bar actuates the switch 98, such as a micro-switch, reed switch or proximity switch. Thus, in these examples, concurrent with this switching, a signal is also received from a smoke sensor 104, sprinkler sensor or any other form of emergency sensing device or upon actuation of a key switch 106 or smoke alarm button, a solenoid lock or the like in the top rail 20 of the wing 18 will release and permit the wing to fold into the breakaway position.

When the revolving door in accordance with this invention is disposed within a building structure, ingress and egress is provided through the spacing between the adjacent side panels 14 of the facing circular panels 11. Normally the electromagnets 48, 80 remain energized. Thus, when an individual causes one of the wings 18 to move, the associated wing hanger 20 along with the shaft 16 also moves. Since the other electromagnets 48 are also energized, the other wing hangers 20 and their associated wings 18 also rotate. In addition, the opposing central panels 12 and the adjacent side panels 14 define a nominally closed position, retaining their opposing semi-circular configurations. Neither the wings 18 will collapse forward, nor will the adjacent side panels 14 collapse in this situation, irrespective of the stack pressure, whether the exterior be colder or warmer than the air in the building structure.

Figure 4:
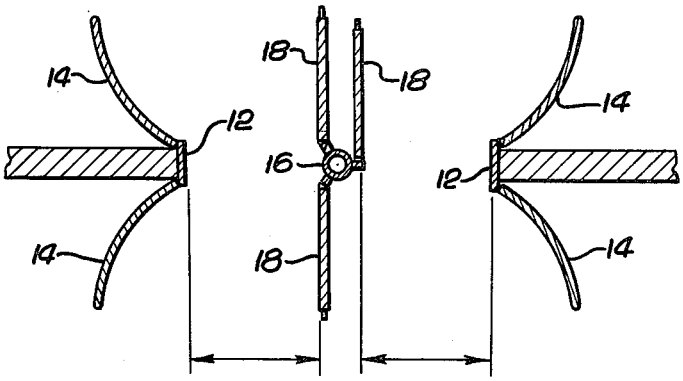
FIG. 4 is a cross-sectional plan view taken along lines 4—4 of FIG. 2.
Figure 7:
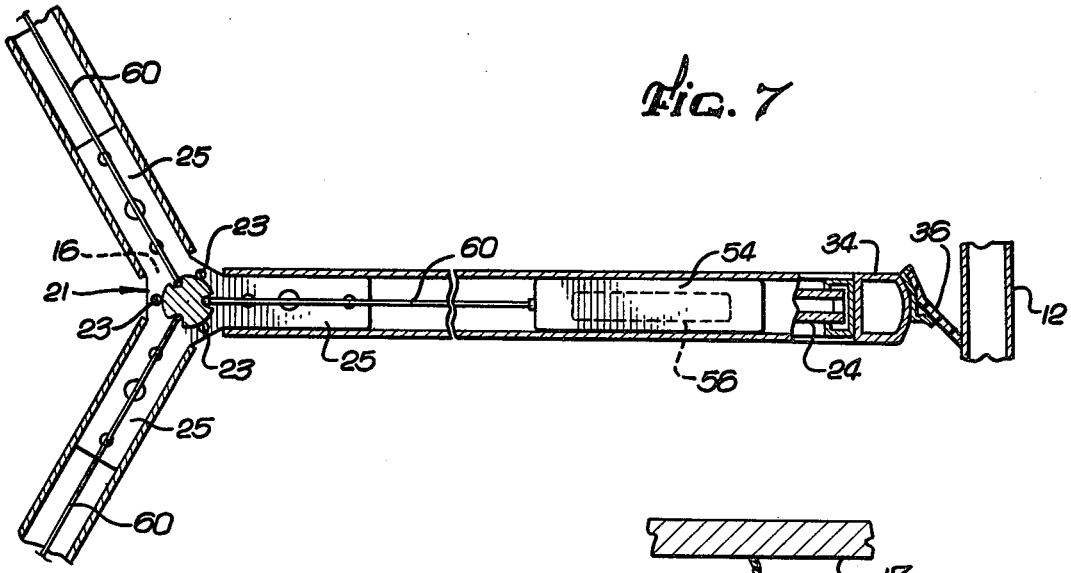
FIG. 7 is a fragmented cross-sectional plan view taken along lines 7—7 of FIG. 6.
Figure 8:
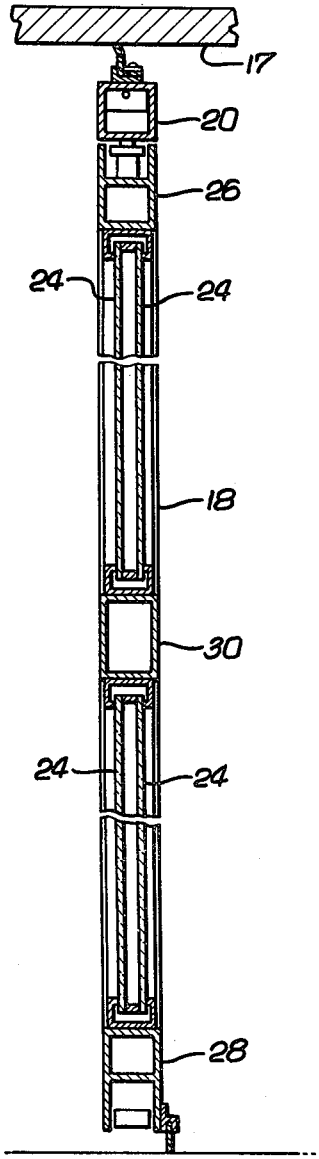
FIG. 8 is a fragemented cross-sectional view taken along lines 8—8 of FIG. 6.

In the event that an emergency does arise, however, the electromagnets 44, 80 are deenergized. This allows the wings 18 to be moved about the pivots 19, to the positions such as shown in FIG. 2, FIG. 4 and FIG. 12. Similarly, the adjacent side panels 14 are free to move outward and are further biased to open outwardly moving about the upright longitudinal hinges to a nominally open panic position. This panic position significantly increases the linear frontage available for emergency exiting of persons from the building, rather than confining the flow of people leaving the building. More than double the linear footage is available for people to enter the revolving door region and exit the revolving door region. In addition, the limited confined area remains reduced only in the region of the opposing central panels 12 as opposed to the outwardly extending panic position of the adjacent side panels 14.

It should be recognized that other latching arrangements may be used, other than an electromagnet latch. By way of example, a solenoid lock or similar electric locking device positioned in the location of the electromagnets may be used. The solenoid would be held in the normally locked condition until released by means of a smoke sensor or other switching device, upon which it would be released, allowing the wings, panels or both to open. A magnet or solenoid lock could be placed in the back edge of the door engaging the center shaft, or positioned in the center shaft and engaging into the back edge of the door.

While the invention has been particularly shown and described with reference to preferred examples thereof, it will be understood by those skilled in the art that various changes in form and details may be made therein without departing from the spirit and the scope of the invention.

What is claimed is:

1. A revolving door system comprising:

a plurality of upright wings;

opposing spaced apart walls partially enclosing the wings to define a region of ingress and egress and a linear frontage between adjacent edges of the opposing spaced apart walls wherein said walls have opposed central portions, and side portions separated by the central portions, the side portions pivotally hinged to the central portions and defining a nominally closed position and a nominally open panic position;

means for releasably maintaining the side portions in the nominally closed position and allowing the side portions to extend to the nominally open position in response to an indication;

central rotation means for radially positioning the wings about a central axis;

means for pivotally coupling the wings to the central rotation means adjacent the central axis; and wing engagement means for releasably locking the wings in arcuate spaced apart relationship and in fixed relationship to each other wing, whereby upon release, the wings are free to pivot and collapse independently of one another to allow an enhanced egress linear frontage in emergency situations.

2. The invention as set forth in claim 1 and in which the wing engagement means are responsive to an indication to allow the wings to pivot upon response to an emergency condition indication.

3. The invention as set forth in claim 1 and in which the wing engagement means are further spaced apart from the axis than the pivot means.

4. The invention as set forth in claim 2 and in which the wing engagement means comprises a magnetic latch.

5. The invention as set forth in claim 1 and in which:

the wing means comprise three wings spaced apart equidistant about the shaft means, each wing defining upper and lower portions;

the pivot means comprising cantilevered upper and lower arms radially extending about the central axis adjacent both upper and lower portions of the shaft means, a pivot and a mating aperture block disposed on each lower arm retaining the lower portions of the wings in pivotal relationship; and the pivot means further comprising walking beam pivot means coupled to the upper arms for pivotally coupling each wing after the lower portion of the wings are pivotally coupled.

6. A revolving door system comprising:

a plurality of upright wings;

opposing spaced apart walls partially enclosing the wings to define a region of ingress and egress and a linear frontage between adjacent edges of the opposing spaced apart walls;

central rotation means for radially positioning the wings about a central axis with the wings substantially abutting the rotating means at one edge, said central rotating means including an upright shaft and a plurality of hanger members rigidly extending from said rotating means, said wings being pivoted from said hanger at one end;

means for pivotally coupling the wings to the central rotation means adjacent the central axis; and wing engagement means for releasably electrically locking the wings in arcuate spaced apart relationship and in fixed relationship to each other wing, whereby upon release, the wings are free to pivot and collapse independently of one another to allow an enhanced egress linear frontage in emergency situations, said engagement means including a first portion mounted on each of said hangers and a second portion mounted on said wings at their top edge to be positioned adjacent said first portion when said portions are engaged.

7. The invention as set forth in claim 6, and in which the walls have opposed central portions, and side portions separated by the central portions, the side portions pivotally hinged to the central portions and defining a nominally closed position and a nominally open panic position;

means for releasably maintaining the side portions in the nominally closed position and allowing the side portions to extend to the nominally open position in response to an indication.

8. A door according to claim 6 wherein said first and second portions of engagement means includes an electromagnet and a armature and wherein said electromagnet and armature have smooth mating surfaces aligned to abut when power is applied to the electromagnet, so that said wings are held adjacent to said hangers by only magnetic forces.

9. A door according to claim 8 wherein said smooth surfaces are planar and parallel.

10. The invention as set forth in claim 9 and in which the central rotation means comprises an upright shaft and radially disposed arm means for supporting the wings, the arm means cantilevered from the shaft.

11. The invention as set forth in claim 9 and comprising:

conductor means for supplying power to the wing engagement means, the conductor means disposed along the hanger means and along the central rotation means;

commutator means for electrically communicating power with the conductor means, the commutator means rotatable with the central rotation means and coupled to the conductor means; and contactor means for supplying current to the commutator means, the contactor means disposed in fixed relationship to the walls.

12. The invention as set forth in claim 6 including a canopy above said walls, and wherein:

the hangers are disposed equidistantly at 120° intervals about the central rotating means;

the rotating means extending upward through the canopy and the commutator means comprising an insulating collar disposed about the shaft above the canopy and comprising a conductive ring electrically coupled to the conducting means and encircling the collar; and the pivot means being disposed sufficiently far from the central axis to allow the wings to pivot when in a released mode, more than 90° from the locked position.

13. A revolving door system comprising:

canopy means for covering opposing semicircular walls of a revolving door;

a plurality of upright wings;

central rotation means for radially positioning the wings about a central axis, the wings rotatable about the central axis;

the wings having a side adjacent the central axis;

opposing spaced apart walls partially enclosing the wings to define a region of ingress and egress, the walls comprising upright opposing central panels, each central panel having opposite sides, and upright adjacent side panels each having an edge;

hinge means for pivotally coupling the side edges to the opposing sides of the central panels; and panel engagement means for releasably engaging the adjacent side panels with respect to the canopy means, whereby the adjacent side panels are free to pivot and collapse outwardly to allow an enhanced egress linear frontage in emergency situations.

14. The invention as set forth in claim 13 and in which the panel engagement means are responsive to an indication to allow the adjacent side panels to pivot outwardly upon receipt of an emergency condition indication.

15. The invention as set forth in claim 13 and in which the panel engagement means are spaced apart from the hinge means.

16. The invention as set forth in claim 15 and in which the panel engagement means comprises a magnetic latch.

17. The invention as set forth in claim 16 and comprising means for biasing the side panels to an opening position.

* * * * *

UNITED STATES PATENT AND TRADEMARK OFFICE

CERTIFICATE OF CORRECTION

PATENT NO. : 4,458,447

DATED : 10 July 1984

INVENTOR(S) : Stanley R. Heise, et al.

It is certified that error appears in the above-identified patent and that said Letters Patent is hereby corrected as shown below:

On the face of the patent, the Assignee should be:

--[73] Assignee: Heise Manufacturing Co., Inc.
Fridley, Minnesota and

Related Energy & Security Systems, Inc.
Evansville, Indiana --.

Column 1, line 32, after "as" insert --a--.

Column 2, line 49, "fragemented" should be --fragmented--.

Column 4, line 3, "through" should be --though--.

Signed and Sealed this

*Eighth* Day of *January 1985*

[SEAL]

*Attest:*

*Attesting Officer*

GERALD J. MOSSINGHOFF

*Commissioner of Patents and Trademarks*